US010843827B2

(12) United States Patent
Nelson et al.

(10) Patent No.: US 10,843,827 B2
(45) Date of Patent: Nov. 24, 2020

(54) STRETCH FILM PROCESSING TO REPLACE STRAPPING

(71) Applicant: Encore Packaging LLC, Lake Bluff, IL (US)

(72) Inventors: Timothy H. Nelson, Winnetka, IL (US); Yinghao Shi, Chicago, IL (US)

(73) Assignee: ENCORE PACKAGING LLC, Lake Bluff, IL (US)

( * ) Notice: Subject to any disclaimer, the term of this patent is extended or adjusted under 35 U.S.C. 154(b) by 322 days.

(21) Appl. No.: 15/804,389

(22) Filed: Nov. 6, 2017

(65) Prior Publication Data

US 2018/0127123 A1 May 10, 2018

Related U.S. Application Data

(60) Provisional application No. 62/418,206, filed on Nov. 6, 2016.

(51) Int. Cl.

| | |
|---|---|
| ***B65B 11/00*** | (2006.01) |
| ***B65B 13/18*** | (2006.01) |
| ***D02G 3/06*** | (2006.01) |

(52) U.S. Cl.

CPC ..... *B65B 11/006* (2013.01); *B65B 13/18* (2013.01); *D02G 3/06* (2013.01)

(58) Field of Classification Search

CPC ..... B65B 11/006; D02G 3/06; D02G 3/08

See application file for complete search history.

(56) References Cited

U.S. PATENT DOCUMENTS

| | | | |
|---|---|---|---|
| 1,895,766 | A | 1/1933 | Murphy |
| 2,351,525 | A | 6/1944 | Leary |
| 2,385,209 | A | 9/1945 | Joyce |
| 2,564,517 | A | 8/1951 | Beals |
| D172,029 | S | 4/1954 | Johnson |
| 3,492,389 | A | 1/1970 | Port |
| 3,754,636 | A | 8/1973 | Boy |
| 3,759,169 | A | 9/1973 | Goodley |
| 3,836,106 | A | 9/1974 | Gray |
| 3,969,793 | A | 7/1976 | Crosby |

(Continued)

FOREIGN PATENT DOCUMENTS

WO 9207761 A1 5/1992

OTHER PUBLICATIONS

Western Plastics Internet Page; "Air-Flow Overview"; http://www.wplastics.com/articles/af_article_004.asp; 2 pages. Available at least as early as Mar. 9, 2013.

(Continued)

*Primary Examiner* — Shaun R Hurley

(74) *Attorney, Agent, or Firm* — Fitch, Even, Tabin & Flannery LLP

(57) ABSTRACT

A stretch film dispensing apparatus gathers the stretch film into a flattened strap for use in securing an object to a pallet for shipping. The stretch film can be converted into a string or rope by passing it through one or more of a hook, funnel, apparatus, set of gears, or the like to effect stretching and/or twisting of the film into a string or rope. The string or rope is then pressed between two rollers biased together with sufficient force to flatten the string or rope into a flattened strap that maintains its structural integrity to be used as a replacement for plastic or metallic strapping.

12 Claims, 12 Drawing Sheets

(56) References Cited

U.S. PATENT DOCUMENTS

| | | | |
|---|---|---|---|
| 4,009,235 | A | 2/1977 | Bober |
| 4,102,513 | A | 7/1978 | Guard |
| 4,166,589 | A | 9/1979 | Hoover |
| 4,255,918 | A | 3/1981 | Lancaster |
| 4,271,657 | A | 6/1981 | Lancaster |
| 4,336,679 | A | 6/1982 | Lancaster |
| 4,387,552 | A | 6/1983 | Lancaster |
| 4,432,185 | A | 2/1984 | Geisinger |
| 4,502,911 | A | 3/1985 | Discavage |
| 4,535,951 | A | 8/1985 | Riemenschneider |
| 4,605,456 | A | 8/1986 | Annis, Jr. |
| 4,671,043 | A | 6/1987 | Forni |
| D295,525 | S | 5/1988 | Sakaki |
| 4,807,427 | A | 2/1989 | Casteel |
| 4,905,451 | A | 3/1990 | Jaconelli |
| D307,435 | S | 4/1990 | Sakaki |
| D308,977 | S | 7/1990 | Sakaki |
| 5,125,209 | A | 6/1992 | Thimon |
| 5,139,403 | A | 8/1992 | Stuart |
| 5,168,685 | A | 12/1992 | Suzuki |
| 5,447,009 | A | 9/1995 | Oleksy |
| 5,452,566 | A | 9/1995 | Benhamou |
| 5,463,843 | A | 11/1995 | Sharp |
| 5,531,393 | A | 7/1996 | Salzsauler |
| D393,201 | S | 4/1998 | Hearidge |
| 5,775,084 | A | 7/1998 | Bernhardy |
| 5,884,857 | A | 3/1999 | Martin-Cocher |
| D415,570 | S | 10/1999 | Bradshaw |
| 6,009,681 | A | 1/2000 | Kozloff |
| D424,078 | S | 5/2000 | Chin-Chang |
| D448,987 | S | 10/2001 | Davis |
| 6,360,512 | B1 | 3/2002 | Marois |
| 6,450,515 | B1 | 9/2002 | Guth |
| 6,463,721 | B1 | 10/2002 | Su |
| 6,568,159 | B2 | 5/2003 | Kawai |
| 6,663,069 | B1 | 12/2003 | Norberg |
| D488,822 | S | 4/2004 | Shibazaki et al. |
| 6,745,544 | B2 | 6/2004 | Matsumoto |
| 6,745,678 | B1 | 6/2004 | Liu |
| 6,789,469 | B1 | 9/2004 | Tipton |
| 6,874,297 | B2 | 4/2005 | Solis |
| 6,994,019 | B1 | 2/2006 | Liu |
| D545,183 | S | 6/2007 | French |
| D546,852 | S | 7/2007 | Shimojima |
| D547,779 | S | 7/2007 | Shimojima |
| 7,263,928 | B1 | 9/2007 | Holden |
| 7,270,055 | B1 | 9/2007 | Haberstroh |
| D552,463 | S | 10/2007 | French |
| 7,357,349 | B1 | 4/2008 | Huang |
| D578,383 | S | 10/2008 | Adams |
| 7,581,368 | B1 | 9/2009 | Bison |
| D608,189 | S | 1/2010 | Jackson |
| 7,779,607 | B2 | 8/2010 | Lancaster |
| 7,908,831 | B1 | 3/2011 | Dugan |
| 8,037,660 | B2 | 10/2011 | Lancaster |
| 8,053,056 | B2 | 11/2011 | Heikaus |
| 8,099,935 | B2 | 1/2012 | Forni |
| D663,357 | S | 7/2012 | Bookhamer |
| D669,773 | S | 10/2012 | Colasse |
| 8,276,346 | B2 | 10/2012 | Lancaster |
| 8,276,354 | B2 | 10/2012 | Lancaster |
| D675,512 | S | 2/2013 | Gary |
| 8,549,819 | B1 | 10/2013 | Bison |
| 8,707,664 | B1 | 4/2014 | Bison |
| D729,025 | S | 5/2015 | Chance |
| 9,850,011 | B2 | 12/2017 | Nelson |
| 10,279,945 | B2 | 5/2019 | Nelson |
| 2003/0009995 | A1 | 1/2003 | Pearson |
| 2004/0098953 | A1 | 5/2004 | Devine |
| 2004/0255562 | A1 | 12/2004 | Haberstroh |
| 2004/0255797 | A1 | 12/2004 | Bobren |
| 2005/0044812 | A1 | 3/2005 | Lancaster |
| 2005/0061165 | A1 | 3/2005 | Powers |
| 2005/0123721 | A1 | 6/2005 | Heikaus |
| 2007/0095991 | A1 | 5/2007 | Fall |
| 2007/0197117 | A1 | 8/2007 | Austin |
| 2007/0204565 | A1 | 9/2007 | Lancaster |
| 2010/0154661 | A1 | 6/2010 | Bobren |
| 2011/0120056 | A1 | 5/2011 | Smith |
| 2011/0120321 | A1 | 5/2011 | Oehm |
| 2011/0233321 | A1 | 9/2011 | Yu Chen |
| 2012/0216688 | A1 | 8/2012 | Liu |
| 2014/0109523 | A1 | 4/2014 | Nelson |
| 2014/0331609 | A1 | 11/2014 | Bison |
| 2015/0203232 | A1 | 7/2015 | Nelson |
| 2015/0274361 | A1* | 10/2015 | Nelson ..... B65D 19/44 53/399 |
| 2017/0305583 | A1* | 10/2017 | Nelson ..... B65H 16/005 |
| 2018/0127123 | A1* | 5/2018 | Nelson ..... B65B 11/006 |
| 2018/0244433 | A1* | 8/2018 | Borchardt ..... B31F 1/20 |

OTHER PUBLICATIONS

Western Plastics Internet Page; "Air-Flow Premium Stretches 200% and Works on All Brand Name Equipment"; http://www.wplastics.com/airflow_premium.asp; 2 pages. Available at least as early as Mar. 9, 2013.

Western Plastics Internet Page; "Air-Flow Premium"; http://www.wplastics.com/pg_ind_page12.asp; 2 pages. Available at least as early as Mar. 9, 2013.

Western Plastics Internet Page; "Air-Flow Sales Soar!"; http://www.wplastics.com/airflow.asp; 2 pages. Available at least as early as Mar. 9, 2013.

Western Plastics Internet Page; 'Air-Flow'; http://www.wplastics.com/pg_ind_page11.asp; 2 pages. Available at least as early as Mar. 9, 2013.

Western Plastics Internet Page; 'Can Air-Flow Solve Your Problems?'; http://www.wplastics.com/articles/af article_003.asp; 2 pages. Available at least as early as Mar. 9, 2013.

Western Plastics Internet Page; "Distributor's Air-Flow Hit List"; http://www.wplastics.com/articles/af_article_002. asp; 2 pages. Available at least as early as Mar. 9, 2013.

Western Plastics Internet page; "How to Apply Air-Flow for the Best Results"; http://www.wplastics.com/articles/af article_006.asp; 2 pages. Available at least as early as Mar. 9, 2013.

Western Plastics Internet Page; 'Seven Reasons Why You Should Sell Air-Flow'; http://www.wplastics.com/articles/af article_001. asp; 2 pages. Available at least as early as Mar. 9, 2013.

* cited by examiner

STRETCH FILM PROCESSING TO REPLACE STRAPPING

RELATED APPLICATIONS

This application claims priority to U.S. provisional application No. 62/418,206, filed on Nov. 6, 2016, which is hereby incorporated by reference in its entirety.

TECHNICAL FIELD

The invention relates generally to the packaging industry and, more specifically, to application of stretch film or wrap to objects.

BACKGROUND

Stretch film or wrap is generally known in the industry as a material that can be used to securely wrap a collection of objects together using the stretch material's resiliency and dinginess. Stretch wrap is typically understood to be a polyethylene stretch film that is generally dispensed from a roll form for use in a variety of applications. For instance, stretch wrap is held against a collection of objects and dispensed and stretched around the collection of objects and wrapped over itself up to several times to cover and hold together the collection of objects. In the shipping industry, for example, a collection of materials may be placed on a pallet to secure such articles together during the shipping process. A collection of boxes placed on a pallet can be shipped as a single cohesive unit when bound together through wrapping with stretch wrap. Other applications of stretch wrap are known such as wrapping agricultural products or simply binding together a collection of items.

Another common application for stretch film is the containment and shipment of agricultural products where these products need to be ventilated to avoid spoilage or for evaporation of water. Current applications use stretch film that has holes cut into the film to allow the film to breath. This process is either done in-line during the manufacturing of the stretch film with expensive equipment or done offline as a secondary operation using expensive equipment to wind, perforate and then rewind the film. Moreover, it is common to secure the wrapped objects to the pallet through use of one or more straps. Such straps are typically metal or plastic bands that wrap over the object and through the pallet's under body. The metal or plastic band has two ends that are pulled tight and clamped together to secure the load to the pallet. Such strapping is expensive and generally not reusable. In addition, it is time consuming as the user must move the strapping over to the package, tighten the strapping with tooling, and then secure the strapping together using some type of mechanical device.

SUMMARY

Generally speaking and pursuant to these various embodiments, a stretch film dispensing apparatus gathers the stretch film into a flattened strap for use in securing an object to a pallet for shipping. The stretch film can be converted into a flattened strap by passing it through one or more of a hook, funnel, apparatus, set of gears, or the like to effect stretching and/or twisting of the film into a string or rope and then flattening the gathered and stretched stretch film between two or more compression rollers. The properties of stretch film allow you to pull it tight, but in the process you are creating memory or resurrecting memory in the film. The more it is stretched the stronger the material gets before reaching the material's breaking point. This memory has a certain amount of elasticity and retention capability in it such that when stretched further during shipping the stretch film naturally retracts some, which is ideal for holding together loads that are moving and unlike typical string or rope that is rigid and does not have much give nor the ability to pull very tight when you pull on it to tighten it up around the package. The described approaches for making the flattened strap from stretch film can be applied to regular, "pre-stretch," and other variations of stretch film, which are referred to collectively as "stretch film."

The stretch film is easy to tie off and then pulled through the knot like string or rope. Companies as a whole, however, are generally not willing to risk their products based on the knot tying ability of their employees. The stretch film properties allow it to be pulled through a clasp, making it easier to achieve additional tension around a load and secure the load in a more consistent basis. A clasp or clamping device that readily traps one end of the string and allows for tightening of the string while then a pulling a second end of the string through a second portion of the clasp or clamping device is ideal to secure a load. The second end of the string can be tied off or clamped on the second portion of the clasp or claiming device to secure the load. The design of the clasp and the stickiness of the stretch film allows the string to stay taught during the tying process and not slip. Furthermore, the design of the clasp allows the stretch film string to be easily loaded while it is still attached to the dispenser so that no material is wasted when the second end is cut after securing the load.

In another approach, the flattened strap can be used just like plastic or metal strapping. For example, the flattened strap made from stretch film can be applied to a load and tightened using a pusher tool in much the same manner as the same pusher tool is used to apply plastic or metal strapping. A seal or serrated seal can then be used to lock the flattened strap in place using a crimping tool using the same process as when such a seal or serrated seal locks in place plastic or metal strapping. The flattened strap is sized to fit existing seals or serrated seals.

The increase in stretch and gathering into strings and further flattening of the stretch wrap results in a strong material that can hold together large loads similar to prior art straps while using a lower cost material, i.e., stretch wrap. By mounting the dispensing device onto a mobile device, such as a cart, the device can be situated next to a pallet for ready application to a load. The described clamps or clasps provide a ready ability to tighten and secure the strings to the load more easily and consistently. For instance, the flattened strap made from stretch film is cheaper than the use of traditional strapping materials. These and other benefits may become clearer upon making a thorough review and study of the following detailed description.

BRIEF DESCRIPTION OF THE DRAWINGS

The above needs are at least partially met through provision of the stretch wrap dispenser described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 4:
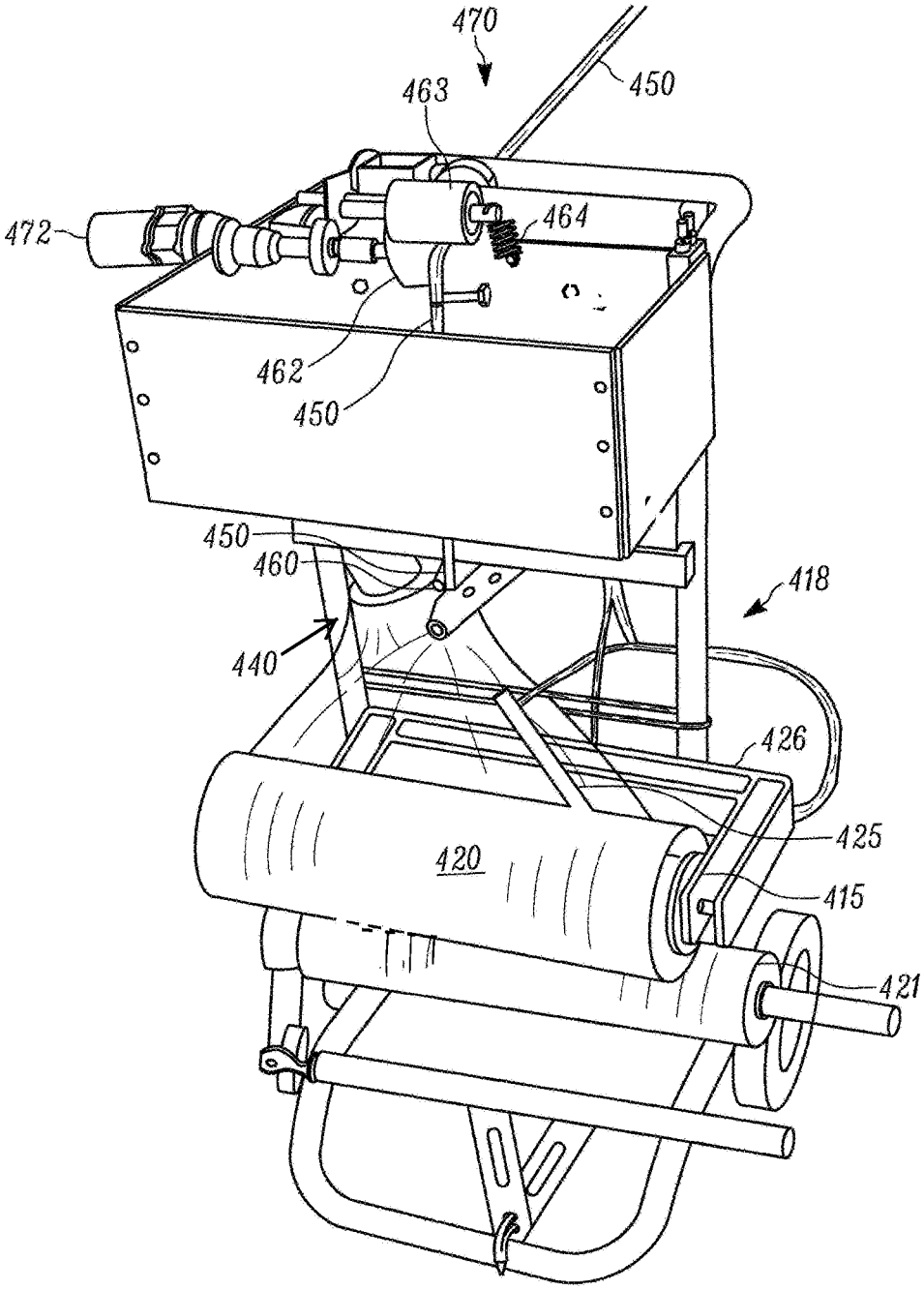
FIG. 4 comprises a perspective view of an example stretch film dispenser for creating string or rope as configured in accordance with various embodiments of the invention.
Figure 5:
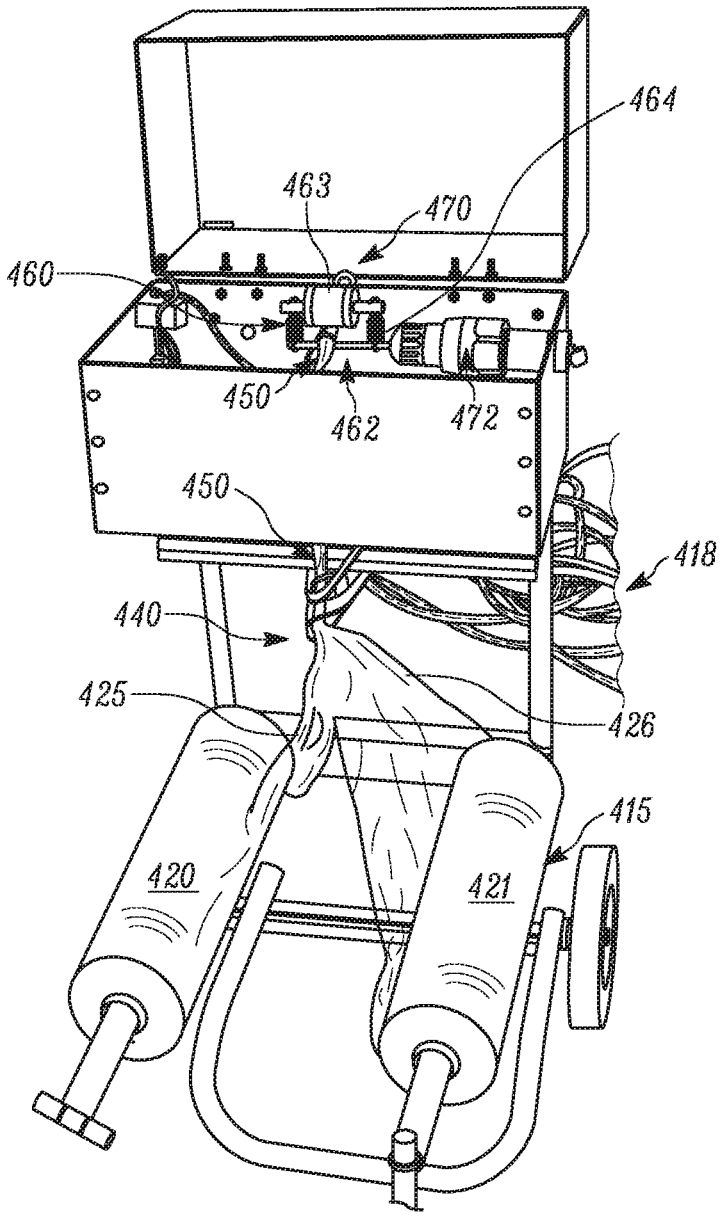
FIG. 5 comprises a perspective view of another example stretch film dispenser for creating string or rope as configured in accordance with various embodiments of the invention.

Referring now to the drawings and, in particular to FIG. 4-12, a device that creates a flattened strap from stretch film will be described. FIGS. 4 and 5 illustrate two different approaches to the roping device where parts whose element numbers are the same perform the same function. In these examples, a support frame 415 is configured to support a roll 420 (alone or together with a second roll 421) of stretch film and dispense the stretch film 425 (and optionally film 426 from the second roll 421) in response to tension on the stretch film 425. The support frame 415 in these examples is mounted onto a cart 418 to facilitate movement around a shipping facility. The cart 418 supports a first gathering device 440 that is disposed to stretch and gather the stretch film 425 into a string 450. The first gathering device 440 may include two substantially similar elements. In this example, the first gathering device 440 defines an aperture that forces stretch film to bind together into a string or rope as it passes through the aperture, although other gathering devices can be used to collect the stretch film into a string or rope.

Figure 1:
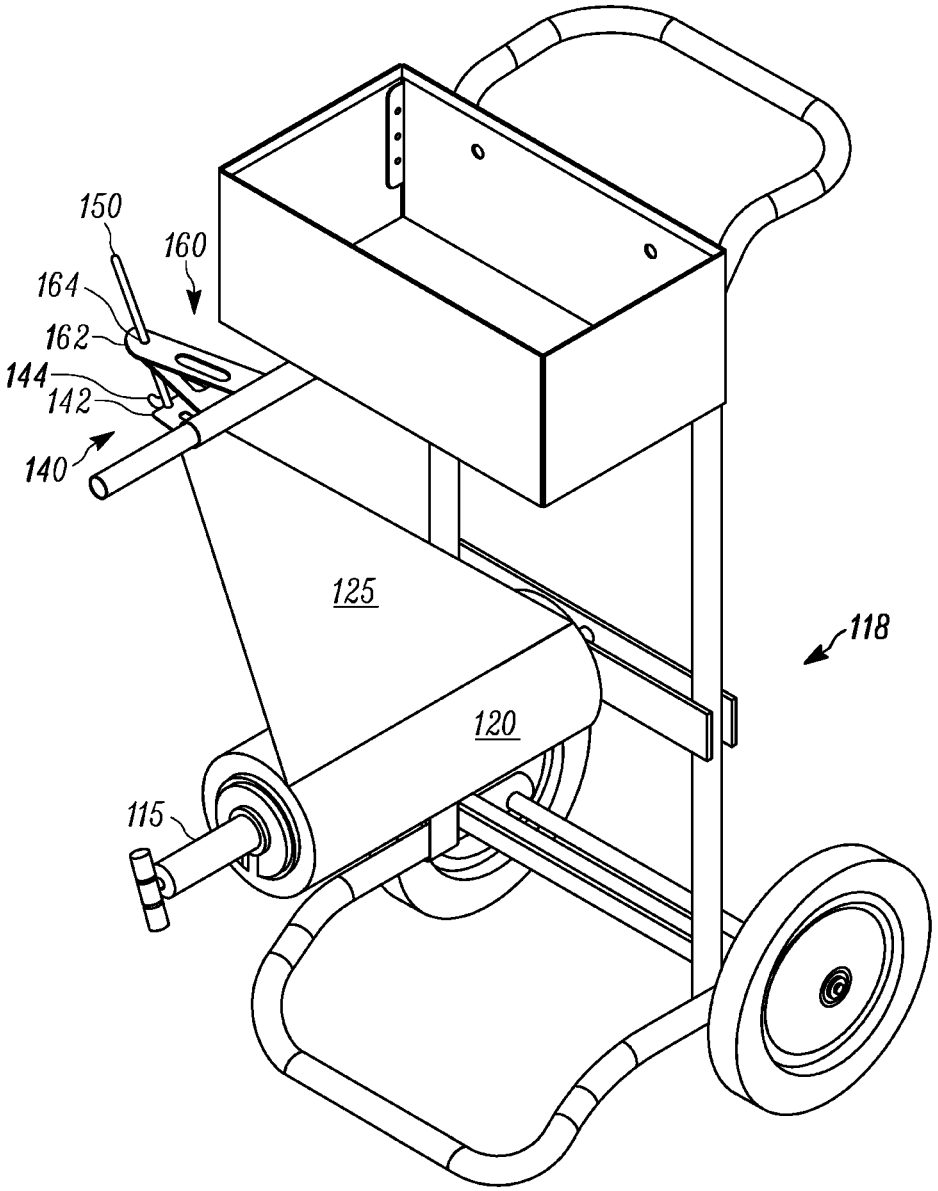
FIG. 1 comprises a perspective view of an example stretch film dispenser for creating string or rope.
Figure 2:
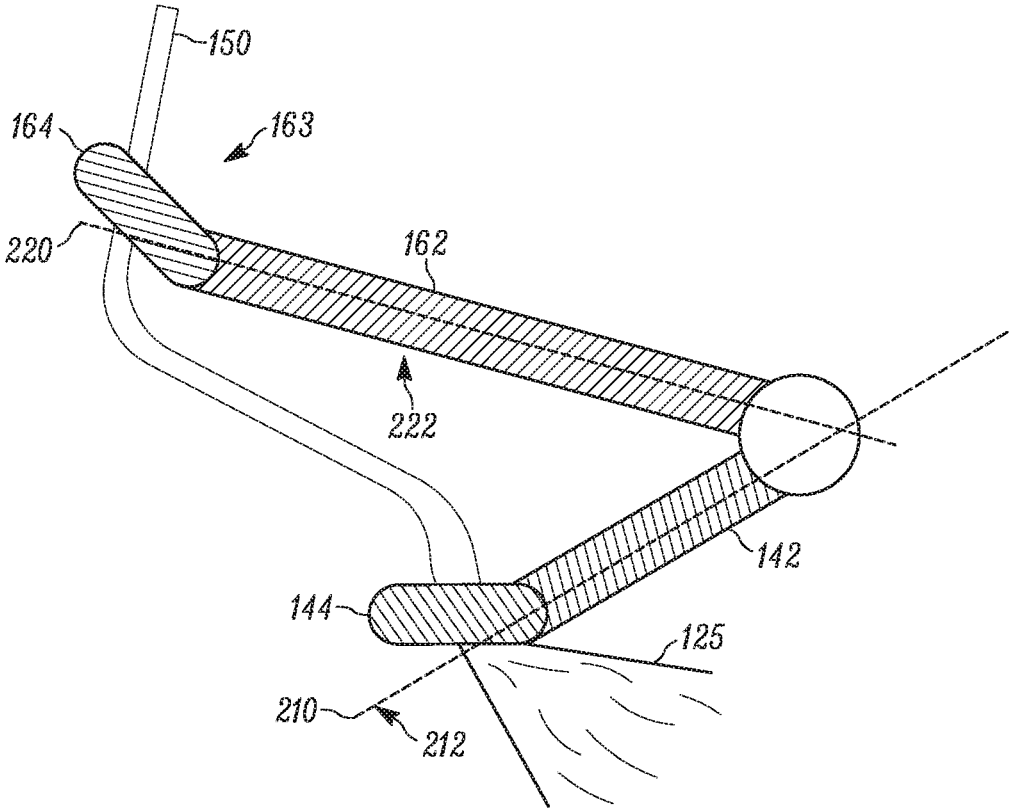
FIG. 2 comprises an expanded view of the gathering device of the stretch film dispenser of FIG. 1.

FIGS. 1 and 2 illustrate a further example of an apparatus for gathering stretch film into a rope or string. In this example, a support frame 115 is configured to support a roll 120 of stretch film and dispense the stretch film 125 in response to tension on the stretch film 125. The support frame 115 in this example is mounted onto a cart 118 to facilitate movement around a shipping facility. The cart 118 supports a first gathering device 140 that is disposed to stretch and gather the stretch film 125 into a string 150 configured to wrap around the object. In one approach, the first gathering device 140 includes a flange 142 extending in a first plane 210. The roll 120 of stretch film 125 is disposed to dispense the stretch film 125 toward the first gathering device 140 from a first side 212 of the first plane 210. A hook device 144 extends from an end of the flange 142 distal from the roll 120 of stretch film 125 and oblique relative to the first plane 210 in a direction opposite the first side 212 of the first plane 210. This first gathering device 140 could alone be the first gathering device for the apparatus of FIGS. 4 and 5, or the first gathering device 140 together with a second gathering device 160 could work together as the initial or first gathering device for the apparatus of FIGS. 4 and 5.

As illustrated in FIGS. 1 and 2, a second flange or second gathering device 160 is disposed to receive the string 150. The second gathering device 160 is configured to in response to a pulling force exerted on the string 150 away from the second gathering device 160 and from the first gathering device 140 one or both of: 1) stretch the string 150 and 2) twist the string 150. By one approach, the second gathering device 160 includes a second flange 162 extending in a second plane 220, wherein the second gathering device 160 is disposed to receive the string 150 from the first gathering device 140 from a first side 222 of the second plane 220. The second gathering device 160 in this example defines an aperture 163 configured to engage and stretch the string 150. The aperture 163 is defined by an extension 164 extending from an end the second flange 160 distal from the roll 120 of stretch film 125 and oblique relative to the second plane 220 in a direction opposite the first side 222 of the second plane 220. In a different approach, the second gathering device comprises a set of dual action gears configured to rotate in response to a pulling action on the string and to engage the string to stretch and twist the string during extraction of the string from the apparatus.

Figure 3:
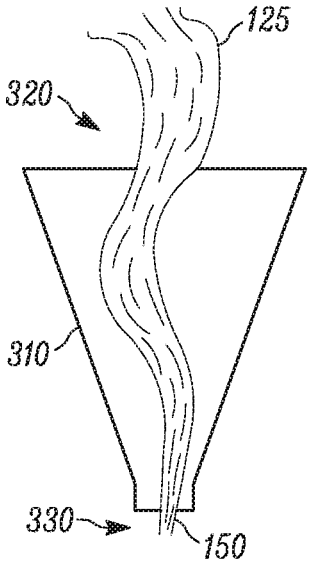
FIG. 3 comprises a cross-section view of a funnel for use in the stretch film dispenser of FIG. 1.

In various approaches, a portion of the second gathering device 160 that is configured to engage the string 150 provides a smaller space through which the string passes as compared to a portion of the first gathering device 140 that is configured to engage the stretch film 125 to stretch and gather the stretch film 125 into the string 150. This step down approach increases the amount of stretch applied the stretch film when forming it into a string, which in turn increases the resulting string's strength. FIG. 3 illustrates one such apparatus used for this string preparation. The illustrated approach can be applied to one or both of the first gathering device 140 and the second gathering device 160. As illustrated, a funnel 310 is configured to receive the stretch film 125 or string 150 through a large end 320 of the funnel 310 and engage, gather, and stretch the stretch film 125 or string 150 as it passes through the large end 320 of the funnel 310 to and through a small aperture 330 of the funnel 310.

Other gathering devices may be used such as rigid rings or washers, or two member directed together to define an aperture. For instance, the surface of the gathering device frictionally grips the stretch film as it is gathered and pulled through the gathering device, which friction causes a tension in the material between the gathering device and whatever is pulling the material from the gathering device. In this manner, the stretch affected by that tension can be modified through particular design of the gathering device, both in its material and aperture size. For instance, the gathering device can be a metal such as stainless steel that naturally grips the stretch film and which device can have an aperture or engaging surface having a width of approximately a half inch. In various approaches, different gathering devices can be used in series to effect different stretch and gathering aspects to the stretch film. The gathering devices may optionally be coated in a variety of materials to effect different stretching forces on engaging the stretch wrap. Descriptions of these and other gathering devices are provided in U.S. Pat. App. Pub. No. 2015/0203232, which is incorporated herein by reference.

Figure 6:
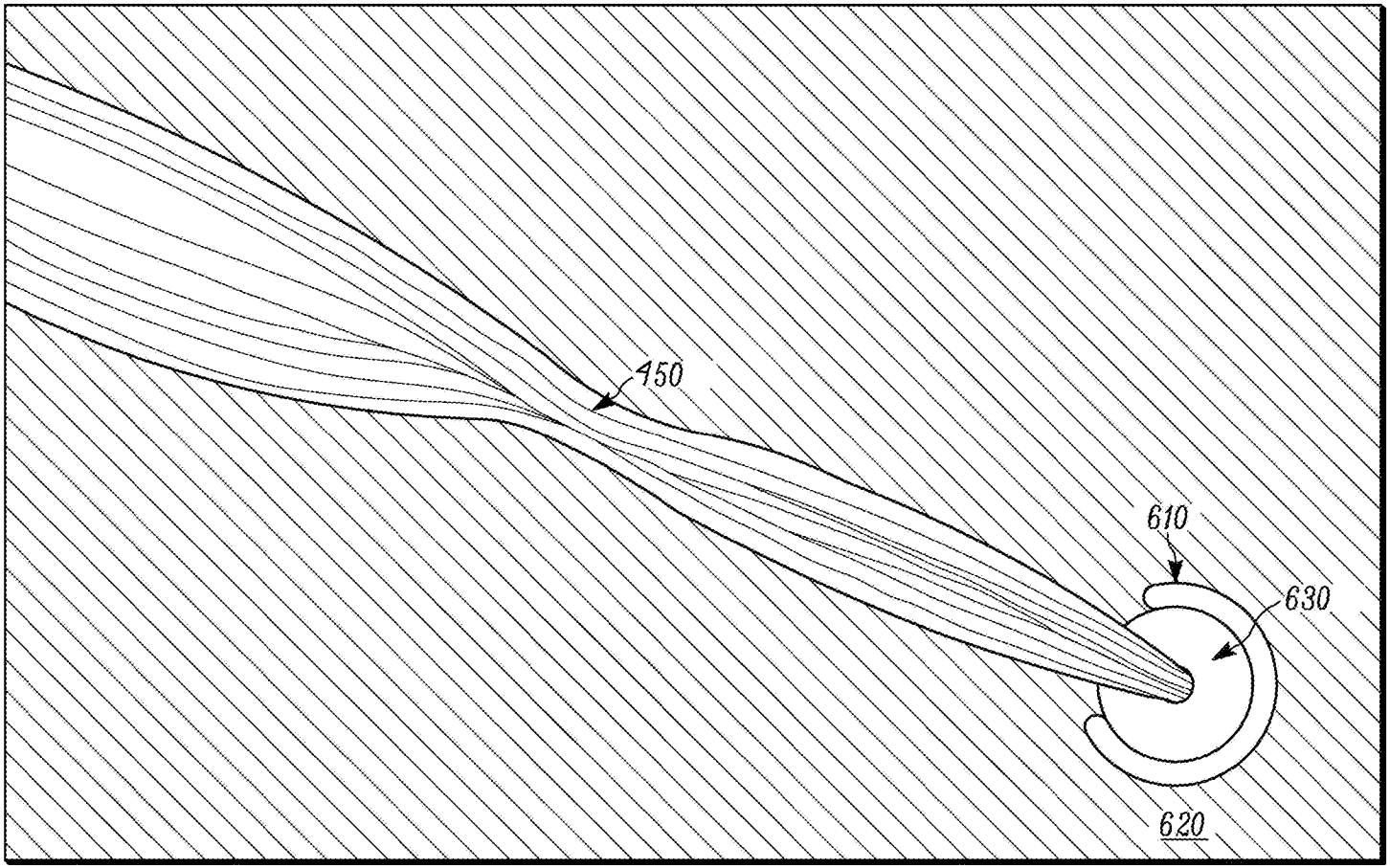
FIG. 6 comprises a perspective view of an example aperture through which stretch film string or rope is pulled as configured in accordance with various embodiments of the invention.

FIG. 6 illustrates another example approach to the first gathering device 440 where two flanges 441 and 442 work together to engage, stretch, and gather the stretch film 425 (and optionally together with second film 426). The first flange 441 includes an end portion 442 that is bent toward the roll of the stretch film 425 relative to the rest of the first flange 441. The end portion 442 defines a slot 443 that is closed on three sides and open on a fourth side in which the stretch film is slotted at the beginning of the operation. The three closed sides of the slot 443 engage the stretch film 425. The second flange 445 includes an end portion 446 that is bent away from the roll of the stretch film 425. Like the first flange 441, the end portion 446 of the second flange 445 defines a slot 447 that is closed on three sides and open on a fourth side in which the stretch film is slotted at the beginning of the operation. The three closed sides of the slot 447 engage the stretch film 425. The second end portion 445 is arranged so that its open side is directed toward a closed side of the first flange's slot 443 to ensure engagement on all sides of the stretch film 425 as it passes through the first gathering device 440. The end portions 442 and 446 are positioned to have a small space 444 between them that is large enough to allow placement of the stretch film 425 at the beginning of the operation, but small enough that the stretch film 425 will not slip out of the first gathering device 440 during operation.

In the examples of FIGS. 4-8, the resulting string 450 passes through an aperture 610 defined in a housing 620 for the second gathering device 460. One example of the aperture 610 is illustrated in FIG. 6. The housing 620 may be any suitable enclosure to allow safe operation of the device. The aperture 610 may be defined at least in part by a polymeric lining 630 that provides the edge that defines the hole and engages the stretch film string 450 as it passes through the aperture 610. This engagement may further stretch and strengthen the string 450. Optionally, a second gathering device can be additionally applied to the string 450 to further improve its strength characteristics.

Figure 7:
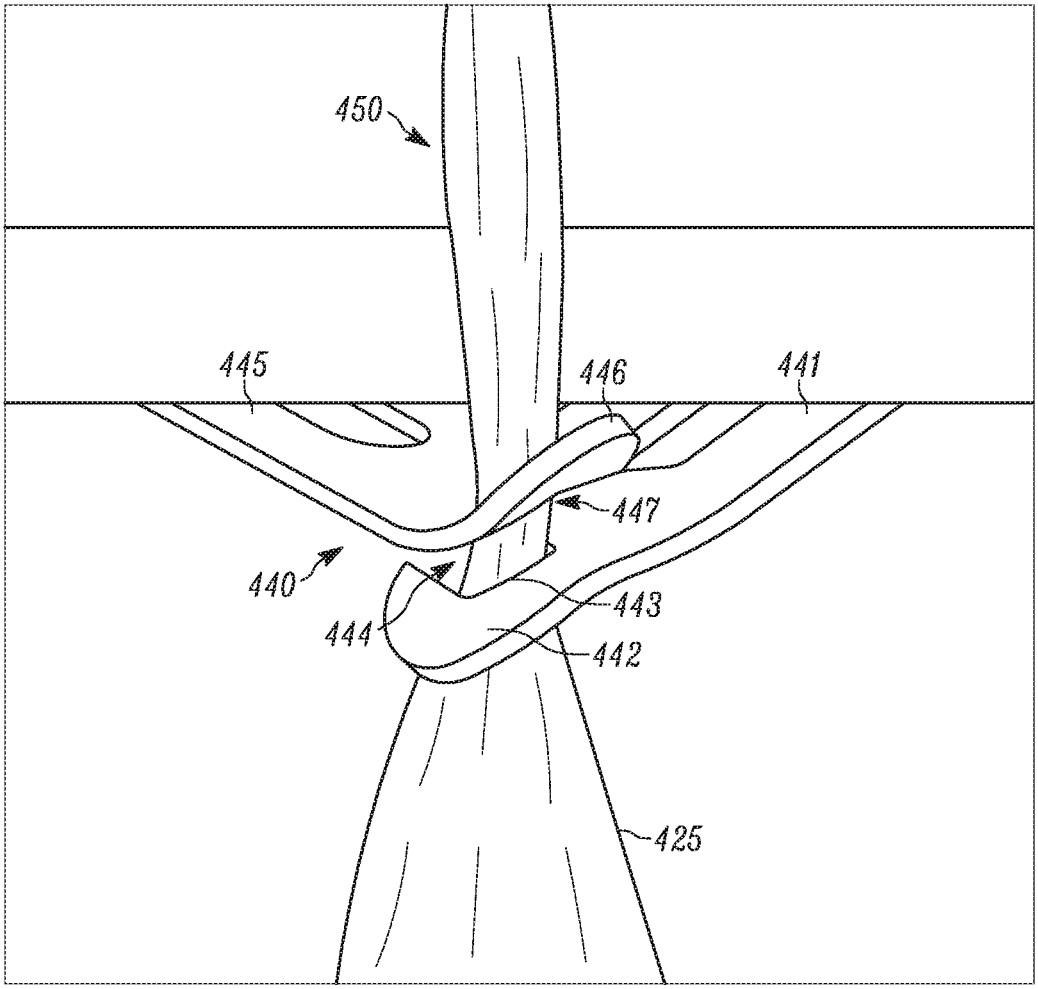
FIG. 7 comprises a perspective view of an example gathering device for a stretch film dispenser for creating string or rope as configured in accordance with various embodiments of the invention.
Figure 8:
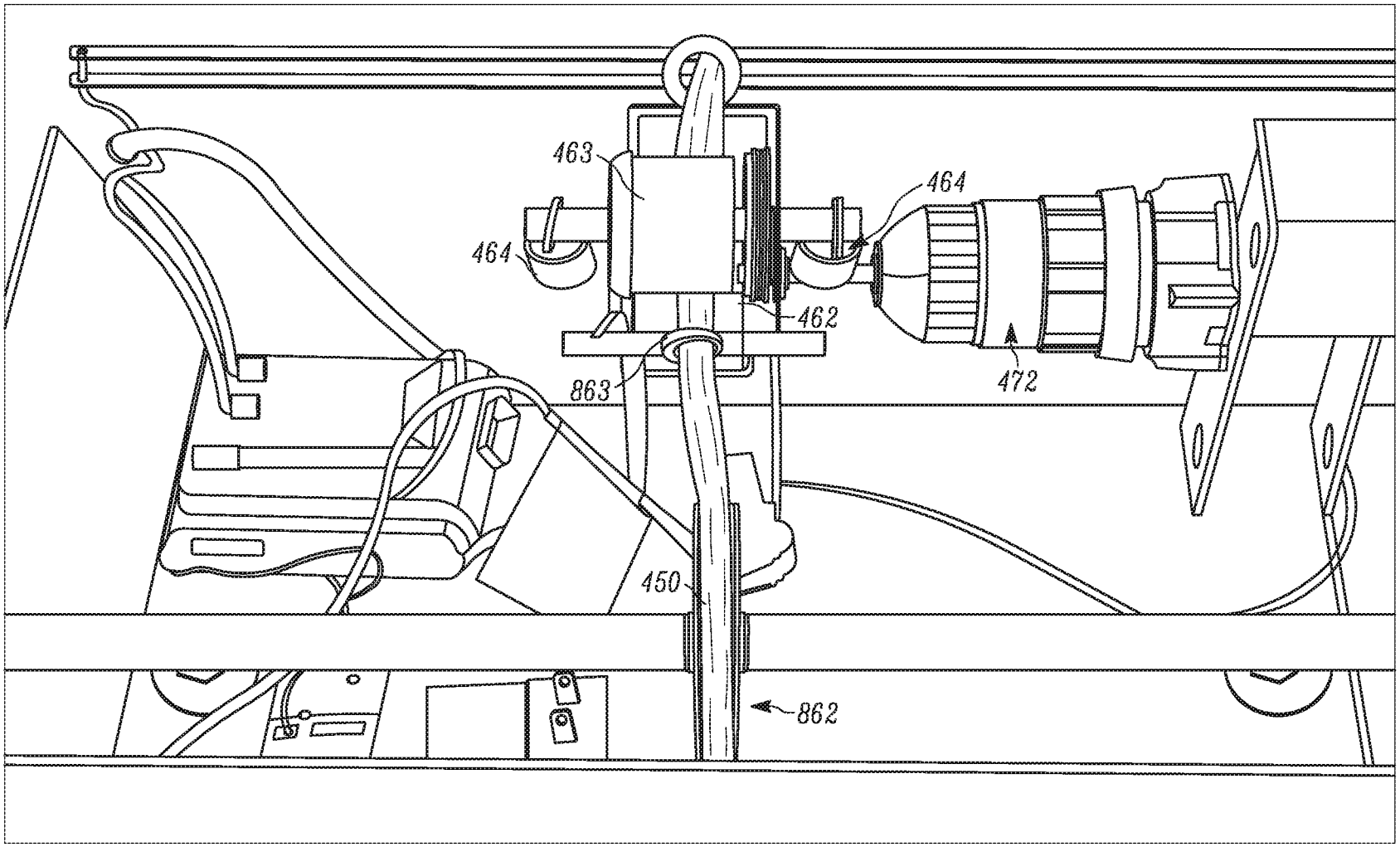
FIG. 8 comprises a perspective view of an example second gathering device for a stretch film dispenser for creating string or rope as configured in accordance with various embodiments of the invention.

Turning to FIGS. 7 and 8, an example of the flattening device will be described. The string 450 passes through the aperture 610 over a pulley 862 and through a ring-like structure 863 to be fed to the flattening device, which includes a first roller 462 and a second roller 463. The pulley 862 may define a groove that holds the string 450 together to direct the string 450 to the next portion of the device. By one approach, the flattening device includes a roller 462 disposed to stretch the string 450 over at least a portion of the first roller's circumference over which the string 450 is stretched as it is pulled over the roller 462. A second roller 463 is biased against the first roller 462 to contact and flatten the string 450 as the string 450 moves between the first roller 462 and the second roller 463. So configured, the second roller 463 provides further resistance against the string 450, thereby stretching and strengthening the string 450 as a result of the further tensioning on the gathered stretch film. For example, the second roller 463 is held against the first roller 462 with springs 464.

The inventors have discovered that when the first roller 462 and the second roller 463 are biased against each other with a sufficiently strong enough force, the string 450 is mashed together and flattened so strongly it maintains its structural integrity enough so as to effectively form a strapping that can replace plastic or metallic strapping. Additionally, the inventors discovered that when flattened at this sufficient pressure to maintain its structural integrity, the flattened strap of stretch film could be used by traditional tools used to secure plastic or metallic strapping to loads. The inventors determined that the rollers 463 and 462 are preferably held together with a force of at least about 150 pounds per square inch, and more preferably 160 pounds per square inch or more.

The first roller 462 is connected to be driven by an actuator such as a motor 472 (or other suitable driver) to drive the first roller 420 to pull the string from the first gathering device, thereby tensioning the string 450 as it is pulled through the gathering device(s) and over and through the rollers 462 and 463. Because the stretch film string's strength and retention properties are improved with increased stretching of the material during the "roping" process, application of the motor 472 can improve the quality of the stretch film string by applying an extra stretching force as compared to a person's pulling the stretch film string through the roping device. Moreover, the force at which the rollers 462 and 463 are biased together requires a motor 472 with sufficient torque to drive the rollers when so strongly held together.

Figure 9:
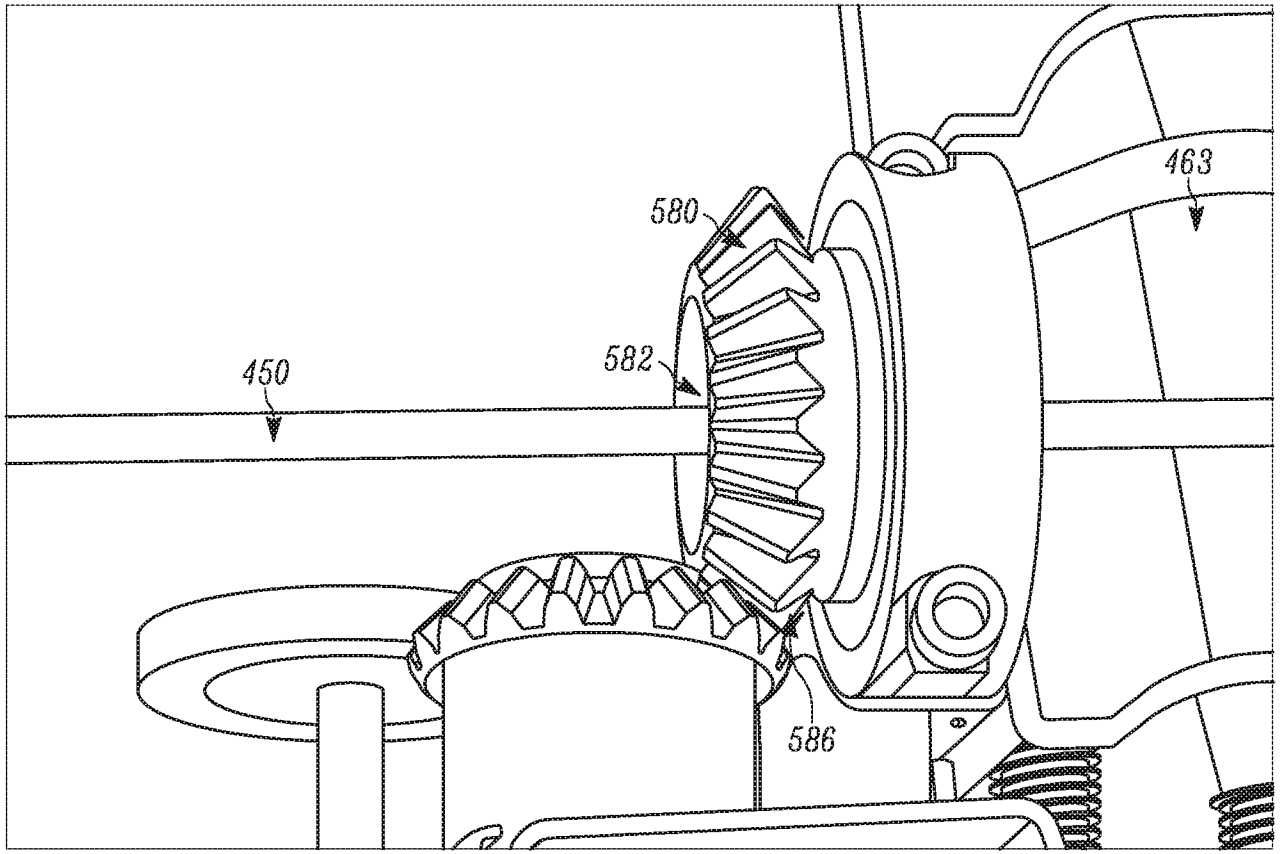
FIG. 9 comprises a top perspective view of an example twisting mechanism for a stretch film dispenser for creating string or rope as configured in accordance with various embodiments of the invention.
Figure 10:
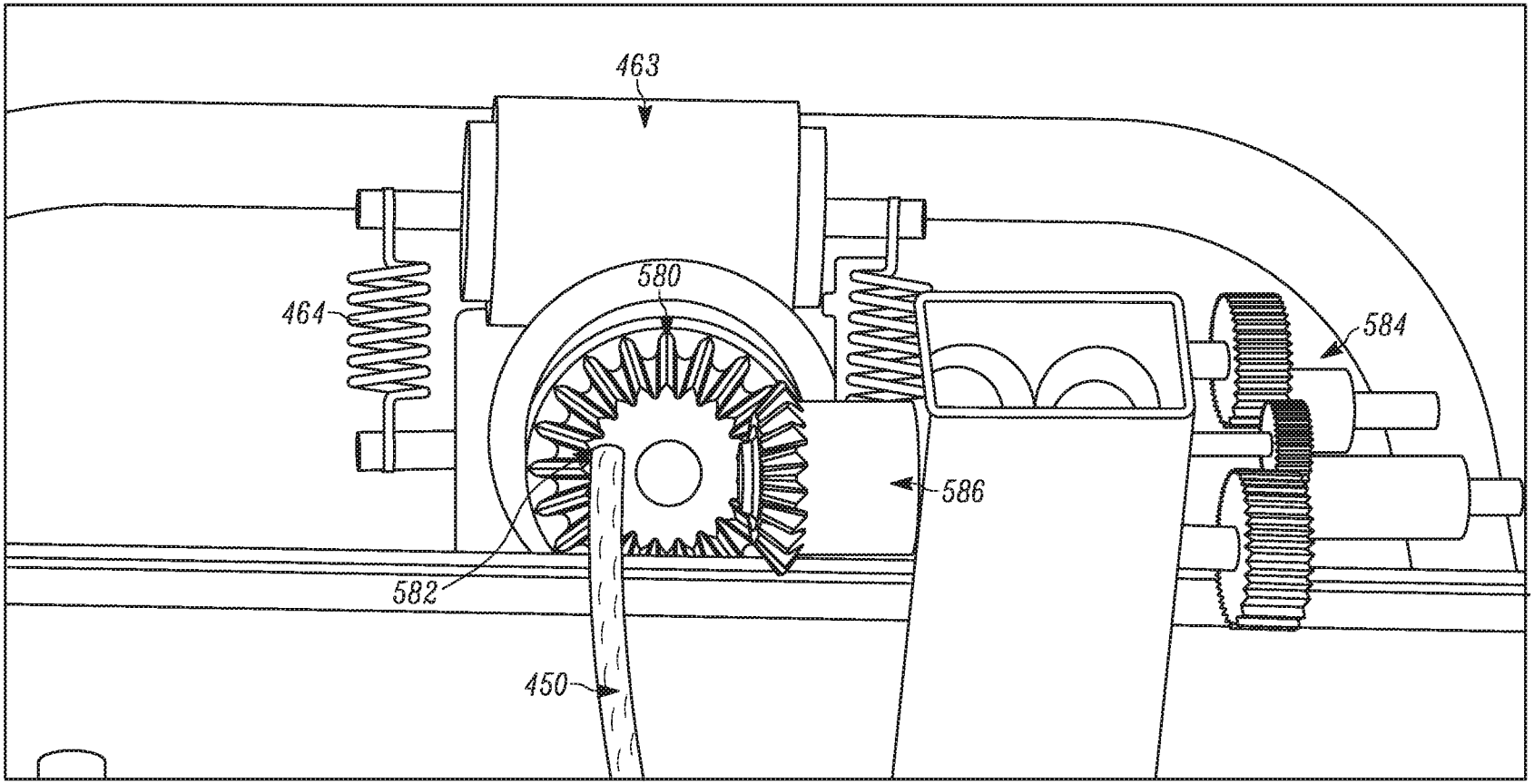
FIG. 10 comprises a back perspective view of another example twisting mechanism for a stretch film dispenser for creating string or rope as configured in accordance with various embodiments of the invention.

In a further aspect, the stretching and twisting apparatus 470 may also include a twisting element disposed to engage the string 450 before the flattening device. Two examples of the stretching and twisting apparatus 470 are illustrated in FIGS. 9 and 10. In these examples, the twisting element includes a gear 580 defining a twisting or gear aperture 582 having a width configured to engage and twist the string 450 through rotation of the gear 580 as the string 450 passes through the gear aperture 582. In the illustrated examples, the motor 472 drives the gear 580 through a set of gears 584 including a bevel gear set 586, although in other applications different gearing or separate motors can be used to drive the gear 580 and the roller 462. By rotating the gear 580 as the string 450 engages and is pulled through the gear aperture 582, the string 450 is further stretched and twisted to provide additional strength to the string 450. In the example of FIG. 9, the gear aperture 582 through which the string 450 passes is defined in the center of the gear 580. In the example of FIG. 10, the gear aperture 582 through which the string 450 passes is defined eccentrically, i.e., offset from the center of the gear 580 to further facilitate twisting of the string 450. Twisting the string into a more traditional "rope" form allows for a tighter pack of the material for handling and further stretches the material by adding the additional twisting deformation in the material. Moreover, where two or more stretch films are combined into a single rope, the twisting step helps combine them together into a more coherent single rope as a result of the dinginess of the stretch films as they are deformed against each other.

Although only a couple of examples are described here, other modifications to the stretch film and stretching and twisting processes are possible. For example, and as illustrated in FIGS. 4 and 5, two sheets of stretch film 425 and 426 from separate rolls 420 and 421, respectively, can be gathered together and stretched and/or twisted together to create a rope having a higher tensile strength. So configured, different stretch film types can be combined to provide different characteristics in the combined string or rope. Additionally, by combining two or more stretch films together into a single rope increases the rope's overall strength.

Figure 11:
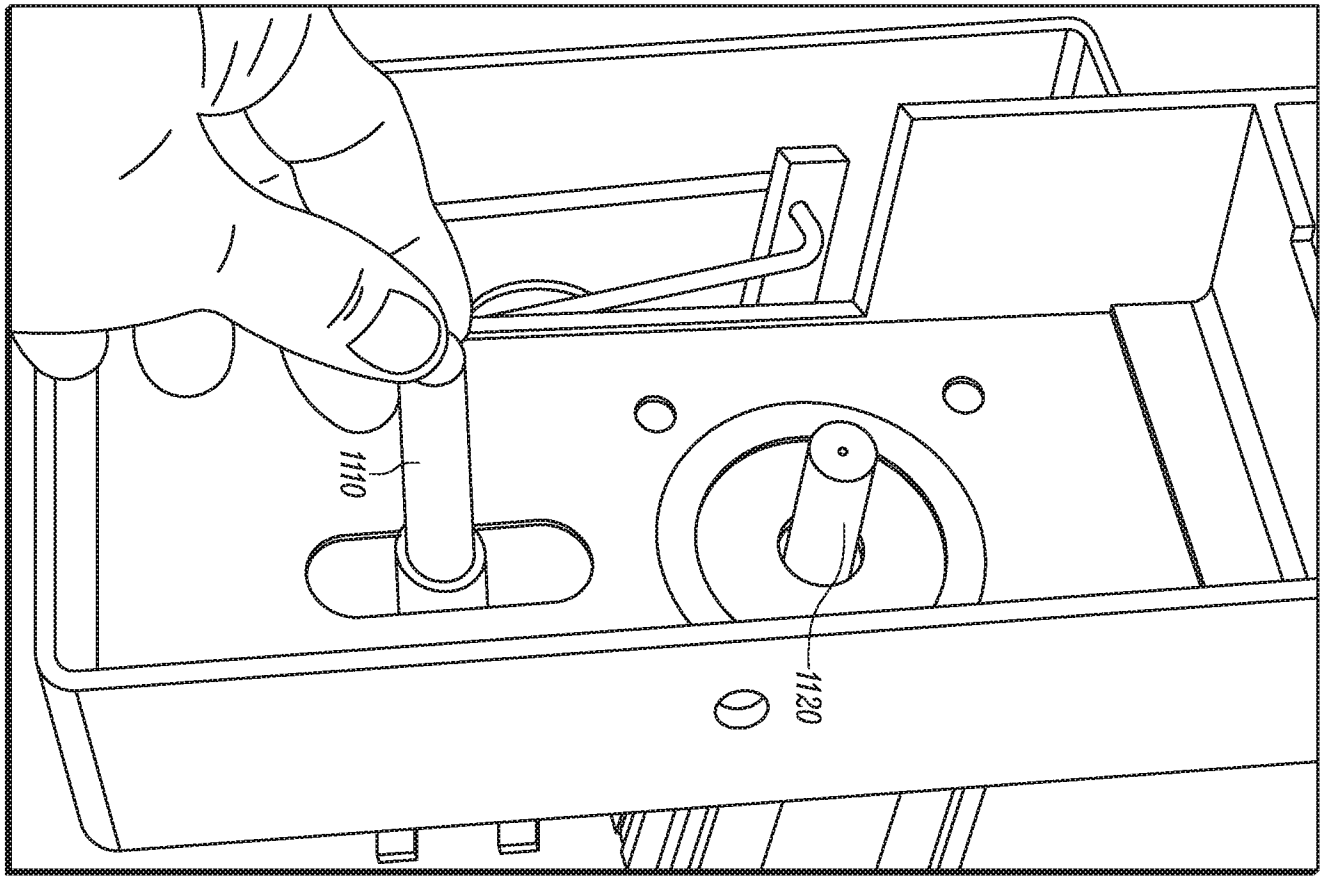
FIG. 11 comprises a perspective view of support shafts for supporting rollers as configured in accordance with various embodiments of the invention.
Figure 12:
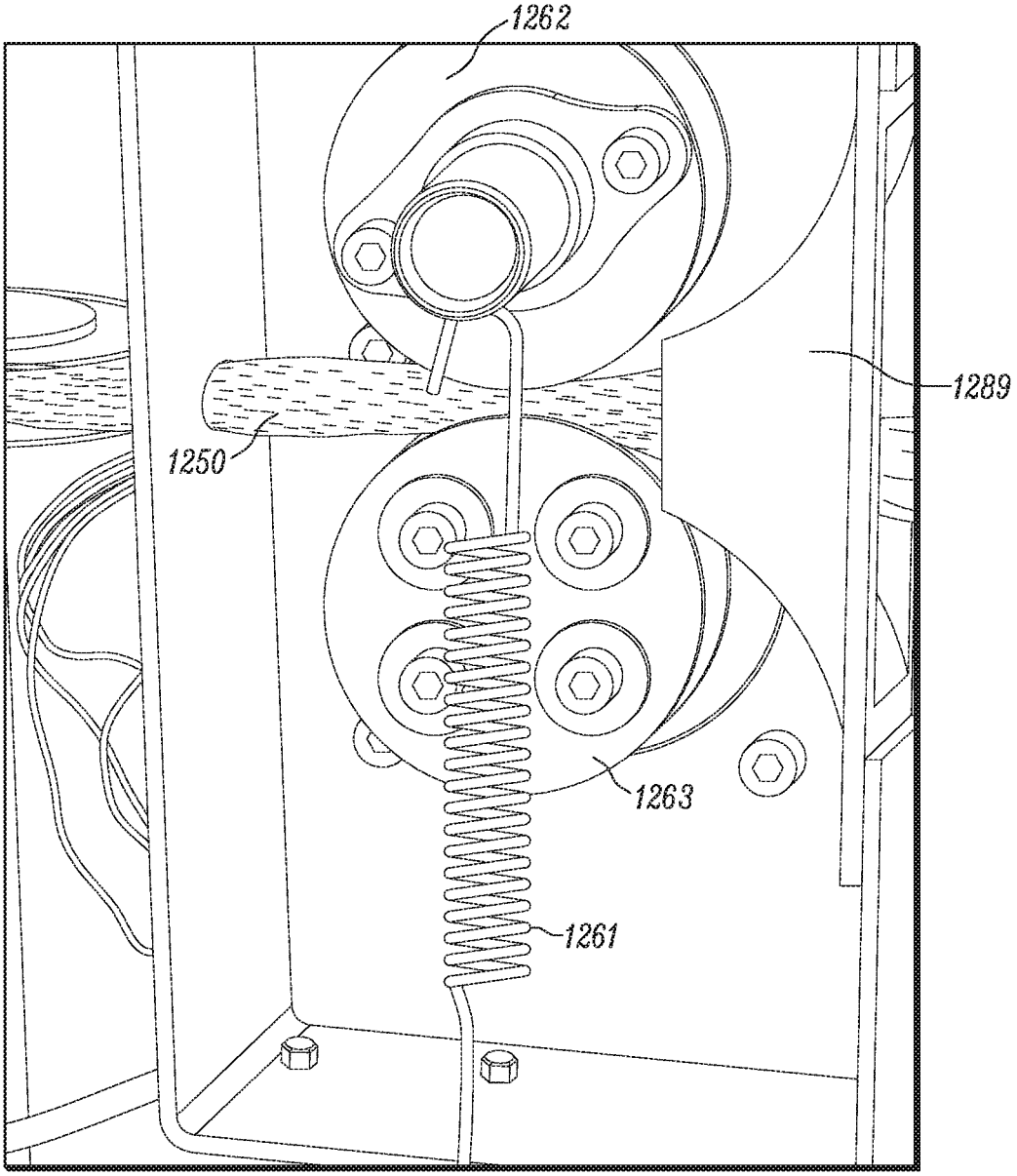
FIG. 12 comprises a perspective view of an example flattening device configured in accordance with various embodiments of the invention.
Figure 13:
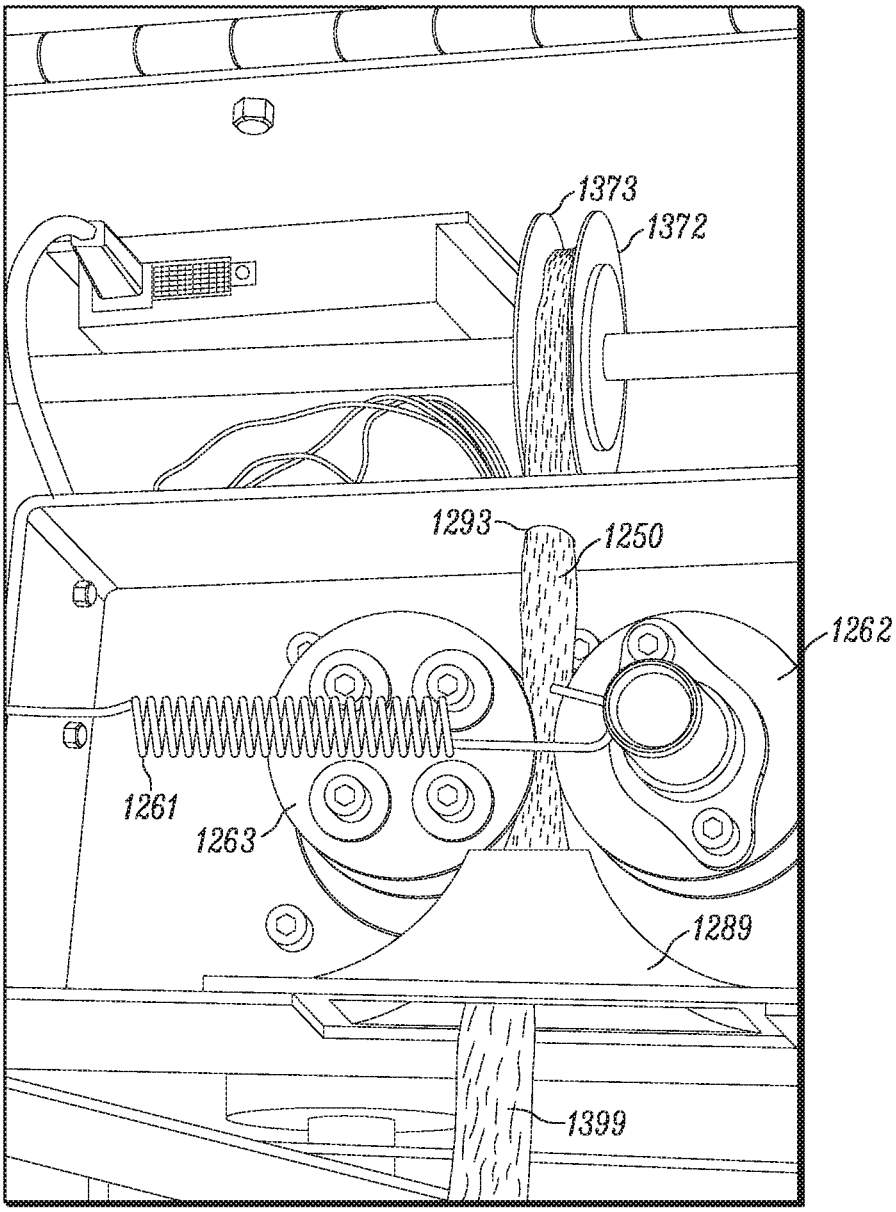
FIG. 13 comprises a second perspective view of the flattening device of FIG. 12.

A further embodiment of portions of the device are illustrated in FIGS. 11-13. FIG. 11 illustrates two shafts 1110 and 1120. The first shaft 1110 is movable relative to the second shaft 120 so that a roller mounted on the first shaft can be biased with a spring or other biasing mechanism against a roller mounted on the second shaft 1120. The second shaft 1120 is mounted to be driven by a motor. FIGS. 12 and 13 illustrate the two rollers 1262 and 1263 mounted on the shafts and biased by a spring 1261. The rollers 1262 and 1263 flatten the string 1250 into a matted strap 1399, and push the matted strap 1399 through funneled aperture 1289 for use by an operator. FIG. 13 illustrates the idler pulley 1372 having a groove 1373 in which the string 1250 is held and directed while pulled by the rollers 1262 and 1263 through a further aperture 1293 to be flattened.

In operation the first shaft 1110 extends such that it can be moved by the user to separate the two rollers 1262 and 1263. This separation can be used to load the stretch film 425 into the dispenser. In some operations, the spring 1261 can be adjusted to alter the compression force applied by the rollers 1262 and 1263. In still further operations, the spring 1261 is disconnected, allowing the rollers 1262 and 1263 to separate. With the rollers 1262 and 1263 separated, the string 1250 is dispensed uncompressed. As such, dispenser 418 is capable of dispensing both string 1250 and compressed strapping 1399.

The matted strapping 1399 is sized to be used with tools and clips configured for standard metal or plastic strapping. In one example, the matted strapping 1399 is approximately ½ inches, approximately ⅝ inches, or approximately ¾ inches in width. As such the matted strapping 1399 can be tightened with a traditional tensioner and secured with a ½ inch, ⅝ inch, or ¾ inch seal, serrated seal, or clip respectively when crimped with a sealer.

So configured, a load can be secured to a pallet using lower cost string or rope made from stretch film instead of metal or plastic strapping. Unlike the approach described in U.S. Pat. App. Pub. No. 2015/0203232 where the stretch rope string is tied to the pallet using hooks or clips, the flattened strap made from stretch film as described herein surprisingly can be readily used by traditional strapping tools to be applied to loads in a manner like prior art plastic or metallic strapping. One would expect that gathered string would lose its form when, for example, used with tensioner tools, flat or serrated seals, and associated clampers or sealers. Instead, the inventors discovered that applying a high enough pressure between the rollers causes the string or rope of stretch film to flatten and maintain its structural integrity in a surprising consistent fashion allowing such use. Thus, the lower cost stretch film using a device such as the one described herein can be used to directly replace plastic or metal strapping. Thus, shipment costs can be reduced without loss of performance in load security.

Those skilled in the art will recognize that a wide variety of modifications, alterations, and combinations can be made with respect to the above described embodiments without departing from the scope of the invention. For instance, the described steps used to create the string or rope from the stretch film can be performed more than once and in any order in any combination. Also, although the steps for creating the stretch film are described with respect to removing stretch film from a roll of same, the same steps could be applied in line with manufacturing of the stretch film instead of being done solely as an after-market adaptation to stretch film dispensed from a roll. In such an application, the rope created can be rolled or otherwise packaged and sold with or without clips for use in securing objects such as those secured to a pallet. Also, the various mechanical aspects described above can be mixed and combined in any way, and additional components can be added. Such modifications, alterations, and combinations are to be viewed as being within the ambit of the inventive concept.

What is claimed is:

1. An apparatus for flattening stretch film into a strap, the apparatus comprising:

a support frame configured to support a roll of stretch film and dispense the stretch film in response to tension on the stretch film;

a first gathering device disposed to stretch and gather the stretch film into a string configured to wrap around an object;

a flattening device disposed to receive the string, the flattening device comprising:

a first roller disposed to stretch the string over at least a portion of the first roller's circumference, and a second roller biased against the first roller, wherein the first roller and the second roller are configured to flatten the string into a flattened strap as the string moves between the first roller and the second roller; and wherein the first roller and the second roller are biased together with at least 150 pounds per square inch of force.

2. The apparatus of claim 1 further comprising an actuator connected to drive the first roller to pull the string from the first gathering device.

3. The apparatus of claim 1 further comprising a twisting element defining a twisting aperture having a width configured to engage the string after the string engages the roller, wherein the twisting element is configured to be rotated to twist the string through engagement with the twisting aperture as the string passes through the twisting aperture.

4. The apparatus of claim 3 wherein the twisting element comprises a gear.

5. The apparatus of claim 4 wherein the twisting element comprises an eccentric aperture defined by the gear.

6. The apparatus of claim 5 wherein the gear comprises a bevel gear connected to be driven by an actuator connected to drive the roller to pull the string from the first gathering device.

7. The apparatus of claim 1 wherein the support frame is configured to support a second roll of second stretch film and dispense the second stretch film in response to tension on the second stretch film, and wherein the first gathering device is disposed to stretch and gather the stretch film and the second stretch film into a single, combined string provided to the flattening device.

8. A method of creating a stretch film flattened strap for securing an object, the method comprising:

dispensing stretch film from a support frame in response to tension on the stretch film, the support frame configured to support a roll of the stretch film;

engaging the stretch film with a first gathering device to gather the stretch film into a string and frictionally engage the stretch film to stretch the stretch film as it is pulled from the first gathering device;

engaging the string with a flattening device, the engaging comprising:

stretching the string over at least a portion of a first roller's circumference, and engaging the string between the first roller and a second roller biased together at a pressure sufficient force, at least 150 pounds per square inch of force, to flatten the string into a flattened strap as the string moves between the first roller and the second roller while at least one of the first roller or the second roller is driven to rotate to pull the string away from the first gathering device to stretch the string.

9. The method of claim 8 further comprising twisting the string by engaging the string with a twisting element defining a twisting aperture having a width configured to engage the string, wherein the twisting element rotates to twist the string through engagement with the twisting aperture as the string passes through the twisting aperture.

10. The method of claim 9 further comprising driving one or both of the first roller and the twisting aperture with an actuator.

11. The method of claim 8 further comprising engaging the string with a second gathering device after engaging the stretch film with the first gathering device.

12. The method of claim 11 further comprising engaging the string with a grooved idler pulley between the first gathering device and the first and second rollers.

* * * * *